United States Patent [19]

Sandnes

[11] 4,017,111

[45] Apr. 12, 1977

[54] SAFETY HOOK

[75] Inventor: Edward S. Sandnes, New Cumberland, Pa.

[73] Assignee: Presco International, Inc., New Cumberland, Pa.

[22] Filed: Apr. 5, 1976

[21] Appl. No.: 673,626

[52] U.S. Cl. ..... 294/82 R; 24/242; 294/78 R

[51] Int. Cl.[2] ..... B66C 1/34

[58] Field of Search ..... 294/78 R, 82 R, 83 R; 24/230, 5 AC, 232 R, 241 P, 241 TC, 241 SL, 241 SP, 241 PL, 241 PS, 242

[56] References Cited

UNITED STATES PATENTS

| | | | |
|---|---|---|---|
| 1,587,678 | 6/1926 | Remington | 24/242 X |
| 2,010,733 | 8/1935 | Netz | 24/232 |
| 2,650,403 | 9/1953 | Taylor et al. | 24/242 |
| 2,857,644 | 10/1958 | Gale | 24/242 |

*Primary Examiner*—Johnny D. Cherry
*Attorney, Agent, or Firm*—Thomas Hooker

[57] ABSTRACT

A safety hook having an improved stop for holding a clevis with respect to the hook to prevent accidental opening of the hook.

5 Claims, 4 Drawing Figures

SAFETY HOOK

The invention relates to safety hooks of the type used to hoist articles in slings where the safety hook includes locking arms which close the hook when it is in the lift position. The arms are held in the closed position to prevent accidental disengagement of the hook from the load when the hook is slack. The locking arms are extensions of the clevis attached to the lifting arm of the sling and are prevented from rotating from the closed position by a tight interference fit between one side of the hook and an intergral projection extending from one of the arms. A spring carried by the pin securing the hook to the arms biases the hook toward the projection and must be overcome in order to pass the hook past the projection and open the hook. This can be done only when the load is slack. A hook of this type is shown in U.S. Pat. No. 2,857,644.

Conventional safety hooks are formed from forged highstrength metal parts which are dipped in molten zinc to provide a protective coating. This protective coating is relatively thick and soft so that with repeated opening and closing of the hook both the projection and the crest of the hook which engages the projection wear thereby reducing the force required to open and close the hook and increasing the possibility that the hook would accidentally open when the load is slack. This problem is conventionally avoided by disassembling the entire safety hook and placing plastic spacing washers between the hook and the arm opposite the arm carrying the projection to take up for the wear in the coating on the hook and the projection. The washers are added by a trial and error process requiring reassembly after each spacer is added and then testing of the safety hook to determine whether the required opening force has been achieved. Frequently the safety hook is disassembled and reassembled a number of times before the desired clearance is attained and the opening and closing forces are reestablished. This process cannot be performed in the field. Slings with safety hooks of this type must be removed from use and returned to a service facility where they are disassembled and washers are added. The process is both expensive and time consuming. In some situations, slings with worn safety hooks are discarded because it is not possible to service them promptly.

The safety hook of this invention eliminates the problems inherent with the conventional safety hook described previously by providing an adjustable insert threadably mounted in an arm of the safety hook with a smooth rounded end extending toward the other arm and engageable with a crest of the hook to restrict movement between the open and closed positions and, in the case the insert is moved further away from its arm, to lock the hook closed.

The rounded end of the insert is smooth and, in the case of a steel insert is electroplated with a thin protective metal coating. Stainless steel and nylon inserts are also contemplated. In each case, the surface of the rounded end is smooth without a thick soft coating so that in the improved hook wear between the insert and the crest of the hook is reduced and the useful life of the safety hook between adjustments is increased.

The position of the insert with respect to the hook can be easily adjusted by inserting a tool into a keyway in the insert and rotating the insert so that the end is moved in or out as desired. In this way, the force required to open and close the hook may be adjusted in the field to compensate the wear and the insert may be extended sufficiently to positively lock the hook in the closed position. This is important in certain situations where it is desired that the hook be attached to a load, cable sling or the like for an indefinite period of time.

Other objects and features of the invention will become apparent as the description proceeds, especially when taken in conjunction with the accompanying drawings illustrating the invention, of which there is one sheet.

Figure 3:
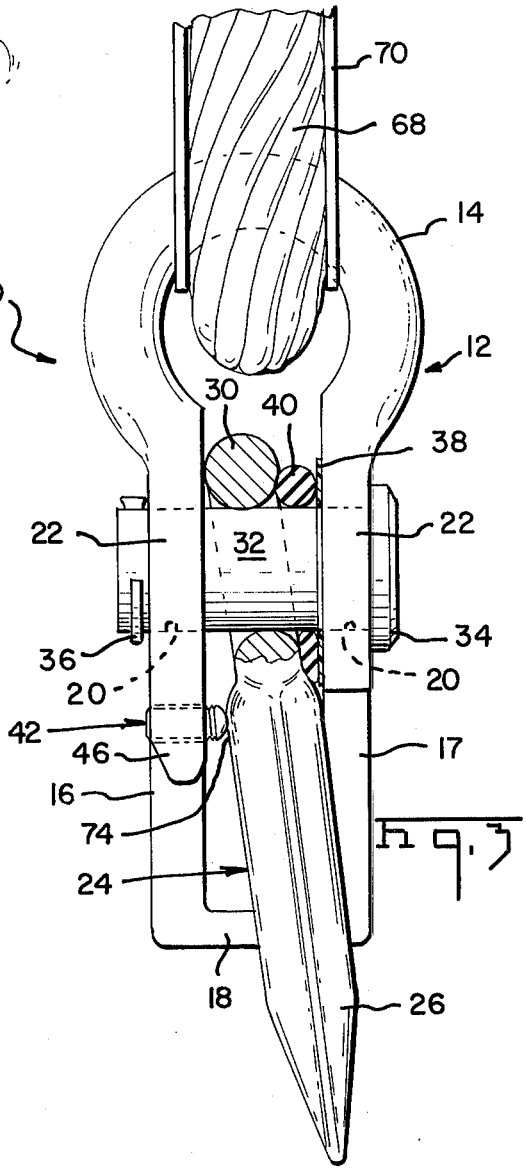
FIG. 3 is a partially broken away view taken along line 3—3 of FIG. 2.
Figure 4:
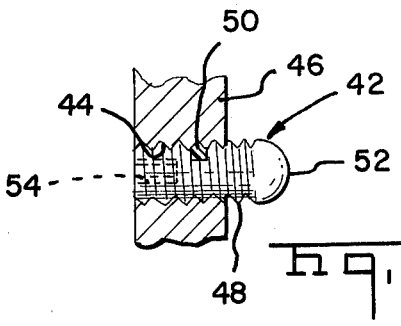
FIG. 4 is a sectional view taken along line 4—4 of FIG. 2.

Safety hook 10 includes a clevis 12 having a bail 14 with a pair of lock arms 16 and 17 extending from the bail with the remote ends of the arms joined by bar 18. Bores 20 extend through enlarged portions 22 of arms 16 and 17 adjacent the bail. Hook 24 includes a curved lower portion 26 with bill 28 on one end and eye 30 on the other end thereof. The hook 24 is secured to the clevis 12 by pin 32 which extends through bores 20 and eye 30 as illustrated in FIG. 3. The pin is secured to the clevis by enlarged head 34 and cotter key 36 located on opposite sides of the clevis. As illustrated in FIG. 3, a flat guard washer 38 is mounted on pin 32 between the hook eye 30 and the arm 17. An annular resilient spring washer 40 is also mounted on pin 32 between washer 38 and hook eye.

An adjustable stop insert 42 is threadably mounted in bore 44 extending through an ear 46 on portion 22 of arm 16. Insert 42 includes a set of threads 48 which engage the threads in bore 44, a resilient locking member 50 which serves to hold the insert 42 in a position with respect to arm 16, a smooth rounded wear surface 52 extending into the space between the arms as illustrated in FIG. 3, and a keyway 54 on the end remote from end 52 to receive a tool so that the insert may be rotated within the bore to position end 52 a desired distance from arm 16.

Figure 1:
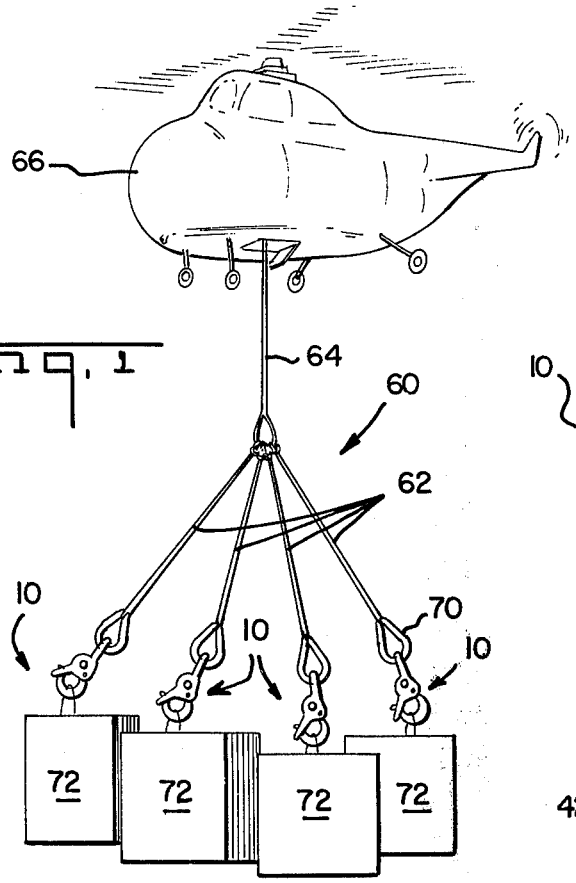
FIG. 1 is a view illustrating the use of a sling having safety hooks according to the invention to lift a number of objects.

FIG. 1 illustrates the use of a sling 60 having a number of load-supporting lengths 62 secured to a main support 64 attached to a suitable lift member, such as helicopter 66. Each arm 62 includes a bite 68 surrounding a protective thimble 70. Both the bite and thimble extend through the opening defined by the bail 14 of a safety hook 10. The safety hooks are attached to objects 72 to be lifted by the sling 60.

Figure 2:
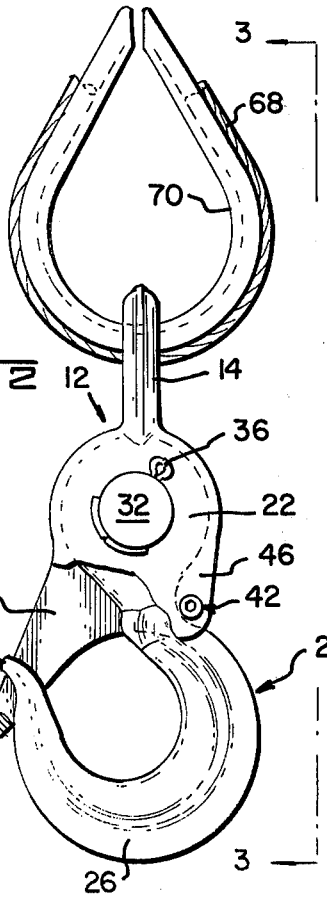
FIG. 2 is a side view, partially broken away, of a safety hook according to the invention.

With the safety hook 10 in the lift position as illustrated in FIG. 2, bar 18 in beneath bill 28 and the opening into the hook is closed by arms 16 and 17. The insert 42 is located on the side of the adjacent crest 74 of hook 24 away from bill 28 and extends a distance away from arm 16 so that the rounded end 52 is spaced from the arm 16 further than the crest 74. Washer 40 normally biases the hook 24 toward the arm 16 to hold the crest past one end of the insert.

The safety hook 10 may be opened by tilting hook 24 to the right as viewed in FIG. 3 to compress the lower section of washer 40 and then rotating the hook about the pin 32 so that crest 74 is brought into engagement with the rounded end 52 of the insert and is slid past the insert, thereby moving the arms away from the opening between bill 28 and eye 30. The fit between the hook and insert is tight, preferably requiring a pull of about 15 to 35 pounds to open and close the hook. With the hook open, the supporting eye of load number 72 may be positioned on the curved portion of the hook and the safety hook may then be closed to return to the position of FIG. 2. The sliding fit between insert end 52 and the crest 74 of hook 24 is sufficiently tight to prevent accidental opening of the safety hook 10 before lifting forces are applied. Normally the fit between the insert and the hook is such that an operator can manually open the hook when attaching or detaching a load from the sling. In cases where it is desired to attach the hook permanently to a load, the insert 42 is threaded into bore 44 a distance sufficiently to move rounded end 52 further beyond the crest 74 than is illustrated in FIG. 3, and in this way positively locking the safety hook in the closed position. In order to remove the load, it is then necessary to back out the insert a sufficient distance to permit relative rotation of the hook 24 and clevis 12.

During opening and closing of safety hook 10, washer 40 rotates with hook 24 and is protected from wearing against the inner surface of adjacent arm 16 by the washer 38 which may be formed from a smooth plastic, such as Nylon.

Safety hook 10 is subject to rough use in adverse environments. To prolong the life of the safety hook, the clevis 14 and hook 24 are preferably provided with a thick protective metal coating, preferably a hot dip zinc coating. While such a coating protects the parts from oxidation, the coating at crest 74 on the hook 24 is worn down by the rounded end 52 of the insert so that after a number of openings and closings of the safety hook the fit between the hook and the insert is loosened. This wear problem is easily eliminated by rotating the insert with respect to the clevis so that the rounded end 52 is moved further toward the hook 24 to reestablish the desired fit between the insert and the crest of the hook. The resilient locking member 50 carried by the insert assures that the insert does not accidentally change position in bore 44. Smoothly rounded insert end 52 reduces wear between the insert and the soft metal coated surface of the hook, thereby increasing the useful life of the safety hook between adjustments of the insert.

The insert 42 may be formed of a ferrous steel, a stainless steel or other atmospherically inert metal or from a resilient plastic such as Nylon. A ferrous steel insert is electroplated to provide a thin smooth protective coating.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim is:

1. A safety hook of the type comprising a clevis with a bail, two arms extending from the end of the bail, bores extending through the arms adjacent the bail to receive a pin; a hook having a curved portion with a bill at one end, an eye at the other end thereof and a rounded crest facing one arm of the clevis; a pin extending through said bores and said eye to secure the hook to the clevis between the arms; the clevis extending to the bill to close the hook when the safety hook is in the closed or weight carrying position; and an annular spring on the pin between the hook and the other arm of the clevis normally positioning the hook adjacent said one arm of the clevis; wherein the improvement comprises a threaded bore extending through said one arm of the clevis radially outwardly of the pin so that the threaded bore sweeps past the crest as the safety hook is moved between the open and closed positions; an insert threadably mounted within said threaded bore and normally extending from said bore towards the hook a distance beyond said crest, the insert having a smooth rounded end facing the rounded crest and a tool engaging feature facing away from the hook to facilitate rotation of the insert with respect to the one arm to position the rounded end a desired distance from the hook whereby the rounded end of the insert lies in the path of movement of the crest as the hook is moved between the open and closed positions and either restricts or prevents rotation of the hook with respect to the bail depending upon such distance.

2. A safety hook as in claim 1 wherein the surfaces of the clevis and hook are provided with a relatively thick soft coating of protective metal, the interior of the bore is coated with such metal and wherein the surface of the insert is resistant to oxidation.

3. A safety hook as in claim 2 wherein said insert is formed of a non-oxidizing steel.

4. A safety hook as in claim 1 including a resilient locking member between the insert and said one arm limiting movement of the insert with respect to such arm.

5. A safety hook as in claim 1 wherein the hook and clevis are coated with a soft thick coating of a non-oxidizing material and the insert is coated with a thin non-oxidizing material.

* * * * *